US008496322B2

(12) United States Patent
Nakamura

(10) Patent No.: US 8,496,322 B2
(45) Date of Patent: Jul. 30, 2013

(54) LIQUID CONTAINER AND IMAGE FORMING APPARATUS

(75) Inventor: Daisuke Nakamura, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 56 days.

(21) Appl. No.: 13/209,534

(22) Filed: Aug. 15, 2011

(65) Prior Publication Data

US 2012/0056953 A1 Mar. 8, 2012

(30) Foreign Application Priority Data

Sep. 2, 2010 (JP) ..... 2010-196588

(51) Int. Cl.
*B41J 2/175* (2006.01)

(52) U.S. Cl.
USPC ..... 347/86; 347/84

(58) Field of Classification Search
USPC ..... 347/84, 85, 86, 87
See application file for complete search history.

(56) References Cited

U.S. PATENT DOCUMENTS

| | | | | |
|---|---|---|---|---|
| 7,661,805 | B2 * | 2/2010 | Usui | 347/92 |
| 8,007,071 | B2 * | 8/2011 | Hayakawa | 347/23 |
| 8,177,343 | B2 * | 5/2012 | Yoshiike | 347/86 |
| 8,272,725 | B2 * | 9/2012 | Tsukamura | 347/86 |
| 2008/0291240 | A1 | 11/2008 | Ohsako et al. | |
| 2010/0194830 | A1 | 8/2010 | Yoshiike | |

FOREIGN PATENT DOCUMENTS

| | | |
|---|---|---|
| JP | 2009-96126 | 5/2009 |
| JP | 2010-221598 | 10/2010 |
| WO | WO 2009/051149 | 4/2009 |

OTHER PUBLICATIONS

European search report dated Jul. 26, 2012 in corresponding European patent application No. 11 17 7706.

* cited by examiner

*Primary Examiner* — Anh T. N. Vo
(74) *Attorney, Agent, or Firm* — Cooper & Dunham LLP

(57) ABSTRACT

A liquid container includes a container main unit, an air release passage, and an air release mechanism. The passage communicates with an interior of the main unit. The air release mechanism is connected to the passage to open and close the passage. The air release mechanism includes a hollow cylindrical member, a valve seat, a valve body, a movable member, an elastic cover member, and a second communication channel. The movable member has an outer circumferential surface slidable over an inner circumferential surface of the cylindrical member and forms a first communication channel to communicate with outside air. The second communication channel has a filter structure to remove foreign substances, is formed within the cylindrical member, and is connected to a space between the cylindrical member and the cover member to communicate the first communication channel with outside air via the space and the second communication channel.

14 Claims, 6 Drawing Sheets

LIQUID CONTAINER AND IMAGE FORMING APPARATUS

CROSS-REFERENCE TO RELATED APPLICATIONS

This patent application is based on and claims priority pursuant to 35 U.S.C. §119 to Japanese Patent Application No. 2010-196588, filed on Sep. 2, 2010, in the Japan Patent Office, the entire disclosure of which is hereby incorporated herein by reference.

TECHNICAL FIELD

This disclosure relates to a liquid container and an image forming apparatus, and more specifically to an image forming apparatus including a recording head for ejecting liquid droplets and a liquid container used in the image forming apparatus.

DESCRIPTION OF THE BACKGROUND ART

Image forming apparatuses are used as printers, facsimile machines, copiers, plotters, or multi-functional devices having two or more of the foregoing capabilities. As one type of image forming apparatus employing a liquid-ejection recording method, an inkjet recording apparatus is known that uses a recording head (liquid-droplet ejection head) for ejecting droplets of ink.

Such liquid-ejection-type image forming apparatuses fall into two main types: a serial-type image forming apparatus that forms an image by ejecting droplets from the recording head while moving the carriage with the recording head in a main scanning direction, and a line-head-type image forming apparatus that forms an image by ejecting droplets from a linear-shaped recording head held stationary in the image forming apparatus as the recording medium is conveyed thereto.

For such a liquid-ejection-type image forming apparatus, for example, JP-2009-096126-A proposes a head tank serving as a liquid container. The liquid container includes an air release mechanism to open and close an air release hole for releasing an interior of a container main unit to outside air. The air release mechanism has a gasket member, a spherical member, and an air-release movable member within a cylindrical air release cap. The spherical member is arranged to come into contact with and separate from the gasket member and be movable from the outside of the liquid container. The air-release movable member is disposed at a position close to the outside air relative to the spherical member so as to be movable back and forth and moves the spherical member. The outer circumferential surface of the movable member is held so as to be slidable over an opening of the air release cap. A communication channel communicating with the outside air is formed within the movable member, and a filter member for capturing foreign substances is mounted to the communication channel.

However, as conventionally performed, in a case in which the filter member is mounted to an opening of the communication channel close to the outside air, for example, dust or other foreign substances may enter the communication channel when bonding the filter member onto the communication channel. In such a case, the foreign substances cannot be removed, thus reducing the air tightness of the valve unit. As a result, the air tightness of the liquid container is compromised and air enters the liquid container, thus hampering stable ink supply.

BRIEF SUMMARY

In an aspect of this disclosure, there is provided an improved liquid container including a container main unit, an air release passage, and an air release mechanism. The container main unit stores liquid to be supplied to a recording head for ejecting droplets of the liquid. The air release passage communicates with an interior of the container main unit to release the interior of the container main unit to outside air. The air release mechanism is connected to the air release passage to open and close the air release passage. The air release mechanism includes a hollow cylindrical member, a valve seat, a valve body, a movable member, an elastic cover member, and a second communication channel. The hollow cylindrical member is connected to the air release passage. The valve seat is disposed within the cylindrical member. The valve body is movably disposed within the cylindrical member to come into contact with and separate from the valve seat. The movable member is movably disposed at a side more proximal to outside air than the valve body within the cylindrical member to move the valve body. The movable member has an outer circumferential surface slidable over an inner circumferential surface of the cylindrical member and forms a first communication channel to communicate with outside air. The elastic cover member is mounted to the cylindrical member to cover the movable member. The second communication channel has a filter structure to remove foreign substances. The second communication channel is formed within the cylindrical member and connected to a space between the cylindrical member and the cover member to communicate the first communication channel with outside air via the space and the second communication channel.

In another aspect of this disclosure, there is provided an improved image forming apparatus including the above-described liquid container.

BRIEF DESCRIPTION OF THE SEVERAL VIEWS OF THE DRAWINGS

The aforementioned and other aspects, features, and advantages of the present disclosure will be better understood by reference to the following detailed description when considered in connection with the accompanying drawings, wherein.

Figure 1:
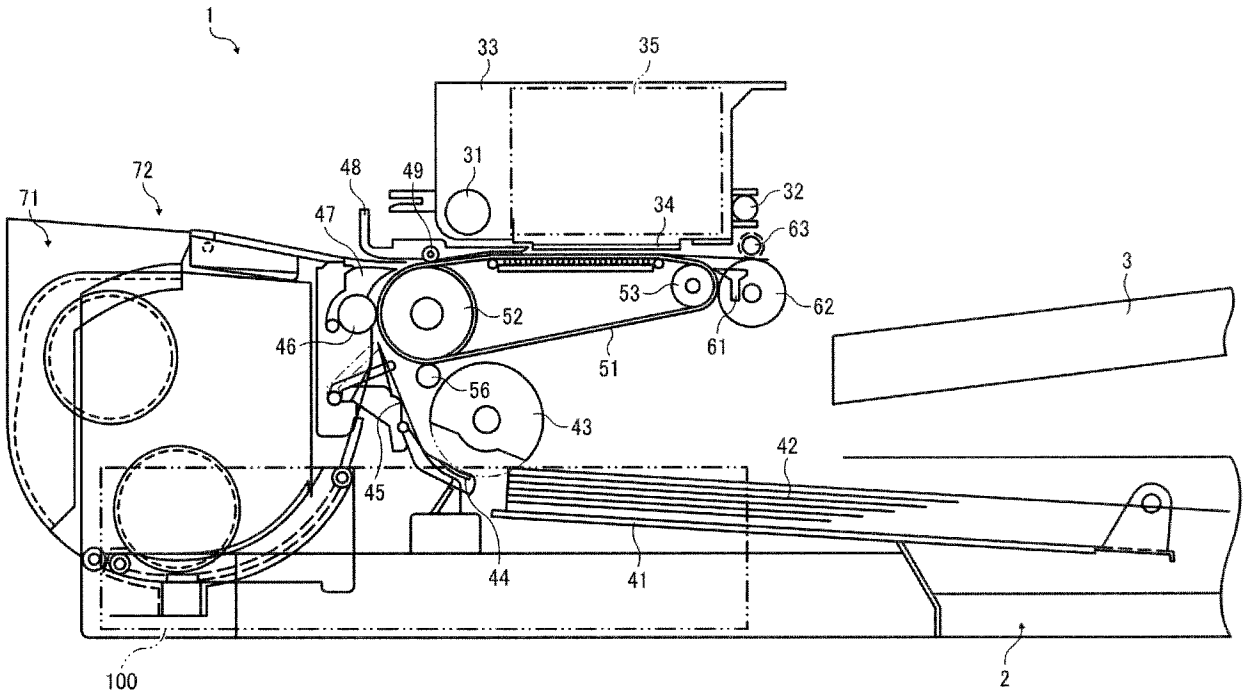
FIG. 1 is a side view of an inkjet recording apparatus as an image forming apparatus according to an exemplary embodiment of this disclosure.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION OF THE INVENTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

In this disclosure, the term "image forming apparatus" refers to an apparatus that ejects ink or any other liquid on a medium to form an image on the medium. The medium is made of, for example, paper, string, fiber, cloth, leather, metal, plastic, glass, timber, and ceramic. The term "image formation", which is used herein as a synonym for "image recording" and "image printing", includes providing not only meaningful images such as characters and figures but meaningless images such as patterns to the medium. The term "ink" as used herein is not limited to "ink" in a narrow sense and includes anything useable for image formation, such as recording liquid, fixing solution, liquid, and resin. The term "sheet" used herein is not limited to a sheet of paper and includes anything such as an OHP (overhead projector) sheet or a cloth sheet on which ink droplets are attached. In other words, the term "sheet" is used as a generic term including a recording medium, a recorded medium, a recording sheet, and a recording paper sheet. The term "image" used herein is not limited to a two-dimensional image and includes, for example, an image applied to a three dimensional object and a three dimensional object itself formed as a three-dimensionally molded image.

Although the exemplary embodiments are described with technical limitations with reference to the attached drawings, such description is not intended to limit the scope of the invention and all of the components or elements described in the exemplary embodiments of this disclosure are not necessarily indispensable to the present invention.

Referring now to the drawings, wherein like reference numerals designate identical or corresponding parts throughout the several views, exemplary embodiments of the present disclosure are described below.

First, an image forming apparatus according to an exemplary embodiment of this disclosure is described with reference to FIGS. 1 and 2.

FIG. 1 is a side view of an entire configuration of the image forming apparatus. FIG. 2 is a plan view of the image forming apparatus. In this exemplary embodiment, the image forming apparatus is described as a serial-type inkjet recording apparatus. It is to be noted that the image forming apparatus is not limited to such a serial-type inkjet recording apparatus and may be any other type of image forming apparatus.

Figure 2:
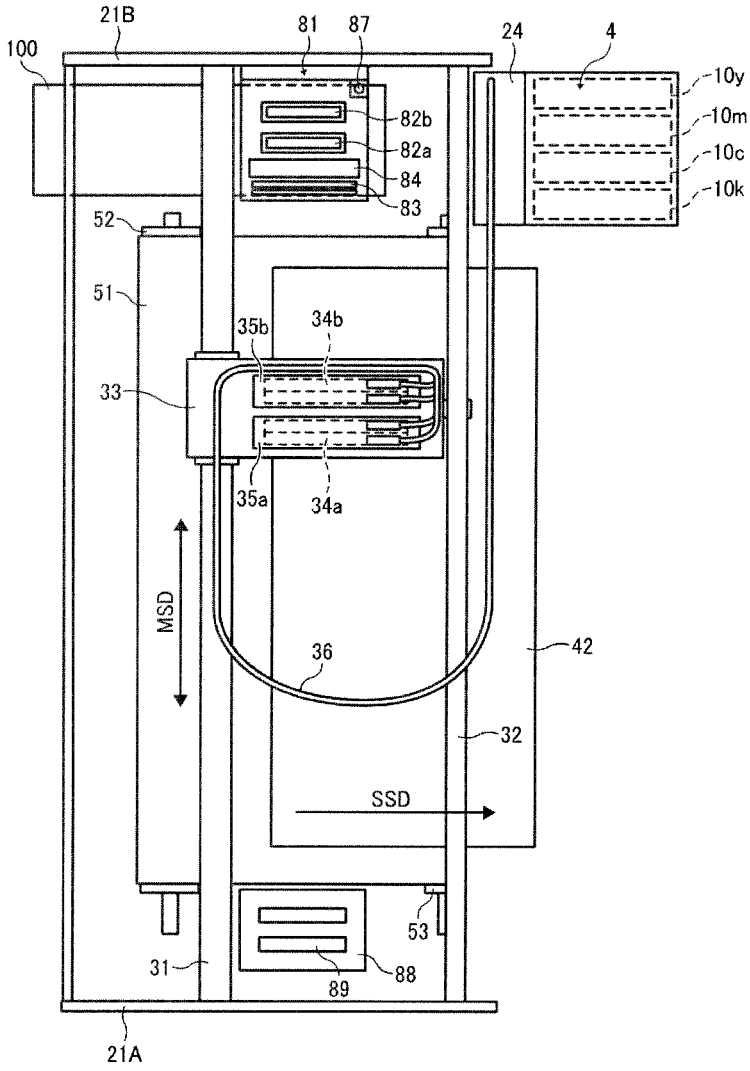
FIG. 2 is a plan view of a mechanical section of the image forming apparatus illustrated in FIG. 1.

In the image forming apparatus, a carriage 33 is supported by a main guide rod 31 and a sub guide rod 32 so as to be slidable in a direction (main scanning direction) indicated by a double arrow MSD in FIG. 2. The main guide rod 31 and the sub guide rod 32 serving as guide members are extended between a left-side plate 21A and a right-side plate 21RB standing on a main unit 1. The carriage 33 is moved back and forth in the main scanning direction by a main scanning motor and a timing belt.

On the carriage 33 are mounted recording heads 34*a* and 34*b* (collectively referred to as "recording heads 34" unless distinguished) that are liquid ejection heads for ejecting droplets of yellow (y), cyan (c), magenta (m), and black (k) inks. The recording heads 34*a* and 34*b* are mounted on the carriage 33 so that multiple rows of nozzles are arranged in a direction (sub-scanning direction) perpendicular to the main scanning direction and ink droplets are ejected downward from the nozzles.

For example, each of the recording heads 34 has two nozzle rows. In such a case, for example, one of the nozzles rows of the recording head 34*a* ejects droplets of black (K) ink and the other ejects droplets of cyan (C) ink. In addition, one of the nozzles rows of the recording head 34*b* ejects droplets of magenta (M) ink and the other ejects droplets of yellow (Y) ink.

On the carriage 33 are mounted sub tanks 35*a* and 35*b* (collectively referred to as "sub tanks 35" unless distinguished) serving as liquid containers for supplying the corresponding color inks to the respective nozzle rows. A pump unit 5 supplies (replenishes) the corresponding color inks from ink cartridges 10*y*, 10*m*, 10*c*, and 10*k* removably mountable in a cartridge mount portion 4 to the sub tanks 35 via ink supply tubes 36 for the respective color inks.

The image forming apparatus further includes a sheet feed section to feed sheets 42 stacked on a sheet stack portion (platen) 41 of a sheet feed tray 2. The sheet feed section further includes a sheet feed roller 43 of, e.g., a half moon shape that separates the sheets 42 from the sheet stack portion 41 and feeds the sheets 42 sheet by sheet and a separation pad 44 that is disposed facing the sheet feed roller 43. The separation pad 44 is made of a material of a high friction coefficient and biased (urged) toward the sheet feed roller 43. In other words, a momentum toward the sheet feed roller 143 is given to the separation pad 144.

To feed the sheets 42 from the sheet feed section to a position below the recording heads 34, the image forming apparatus includes a first guide member 45 that guides the sheet 42, a counter roller 46, a conveyance guide member 47, a press member 48 including a front-end press roller 49, and a conveyance belt 51 that conveys the sheet 42 to a position opposing the recording heads 34 with the sheet 42 electrostatically attracted thereon.

The conveyance belt 51 is an endless belt that is looped between a conveyance roller 52 and a tension roller 53 so as to circulate in a belt conveyance direction, that is, the sub-scanning direction indicated by an arrow "SSD" illustrated in FIG. 2. A charge roller 56 is provided to charge the surface of the conveyance belt 51. The charge roller 56 is disposed so as to contact the surface of the conveyance belt 51 and rotate in accordance with the circulation of the conveyance belt 51 (i.e., rotate by receiving a force transmitted from the conveyance belt 51). The conveyance roller 51 is rotated by a sub-scanning motor, not illustrated, via a timing roller, so that the conveyance belt 51 circulates in the belt conveyance direction, i.e., the sub-scanning direction "SSD" illustrated in FIG. 2.

The image forming apparatus further includes a sheet output section that outputs the sheet 42 on which an image has been formed by the recording heads 34. The sheet output section includes a separation claw 61 that separates the sheet 42 from the conveyance belt 51, a first output roller 62, a second output roller 63, and a sheet output tray 3 disposed below the first output roller 62.

A duplex unit 71 is detachably mounted on a rear portion of the main unit 1. When the conveyance belt 71 rotates in the reverse direction to return the sheet 42, the duplex unit 71 receives the sheet 42. Then the duplex unit 71 turns the sheet 42 upside down to feed the sheet 42 between the counter roller 46 and the conveyance belt 51. At the top face of the duplex unit 71 is formed a manual-feed tray 72.

As illustrated in FIG. 2, a maintenance-and-recovery unit 81 is disposed at a non-printing area (non-recording area) that is located on one end in the main-scan direction of the carriage 33. The maintenance-and-recovery unit 81 maintains and recovers nozzle conditions of the recording heads 34. The maintenance-and-recovery unit 81 includes caps 82*a* and 82*b* (hereinafter collectively referred to as "caps 82" unless distinguished) to cover the nozzle faces of the recording heads 34, a wiper member (wiper blade) 83 to wipe the nozzle faces of the recording heads 34, a first droplet receptacle 84 to receive ink droplets discharged to remove increased-viscosity ink during maintenance ejection, and a carriage lock 87 to lock the carriage 33. Below the maintenance-and-recovery unit 81, a waste liquid tank 100 is removably mounted to the main unit 1 to store waste ink or liquid generated by the maintenance and recovery operation.

As illustrated in FIG. 2, a second droplet receptacle 88 is disposed at a non-recording area on the other end in the main-scan direction of the carriage 33. The second droplet receptacle 88 receives ink droplets that are discharged to remove increased-viscosity ink during, e.g., recording (image forming) operation. The second droplet receptacle 88 has openings 89 arranged in parallel with the rows of nozzles of the recording heads 134.

In the image forming apparatus having the above-described configuration, the sheet 42 is separated sheet by sheet from the sheet feed tray 2, fed in a substantially vertically upward direction, guided along the first guide member 45, and conveyed between the conveyance belt 51 and the counter roller 46. Further, the front tip of the sheet 42 is guided with a conveyance guide 37 and pressed against the conveyance belt 51 by the front-end press roller 49 to turn the traveling direction of the sheet 42 by substantially 90°.

At this time, positive and negative voltages are alternately supplied to the charge roller 56 so that the conveyance belt 51 is charged with an alternating voltage pattern, that is, an alternating band pattern of positively-charged areas and negatively-charged areas. When the sheet 42 is fed onto the conveyance belt 51 alternately charged with positive and negative charges, the sheet 42 is attracted on the conveyance belt 51 and conveyed in the sub-scanning direction by circulation of the conveyance belt 51.

By driving the recording heads 34 in response to image signals while moving the carriage 33, ink droplets are ejected onto the sheet 42, which is stopped below the recording heads 34, to form one band of a desired image. Then, the sheet 42 is fed by a certain distance to prepare for the next operation to record another band of the image. Receiving a signal indicating that the image has been recorded or the rear end of the sheet 42 has arrived at the recording area, the recording heads 34 finish the recording operation and the sheet 42 is outputted to the sheet output tray 3.

To perform maintenance-and-recovery operation of the nozzles of the recording heads 34, the carriage 33 is moved to a home position at which the carriage 33 opposes the maintenance-and-recovery unit 81. Then, maintenance-and-recovery operation, such as nozzle suctioning operation for suctioning ink from nozzles with the nozzle face of the recording heads 34 covered with the caps 82 and/or maintenance ejection for ejecting droplets of ink not contributed to image formation, is performed, thus allowing image formation with stable droplet ejection.

Figure 4:
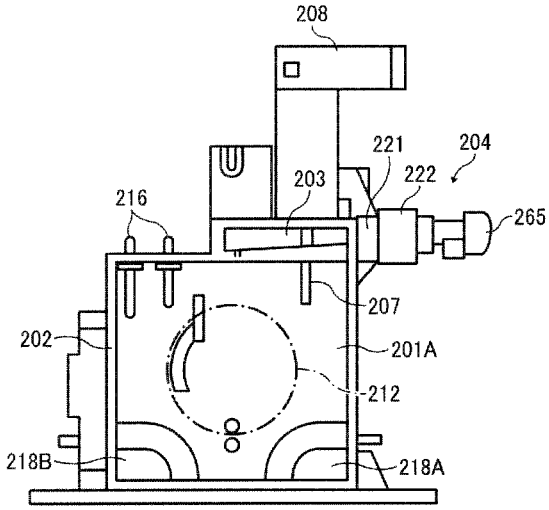
FIG. 4 is a side view of the liquid container illustrated in FIG. 3.
Figure 5:
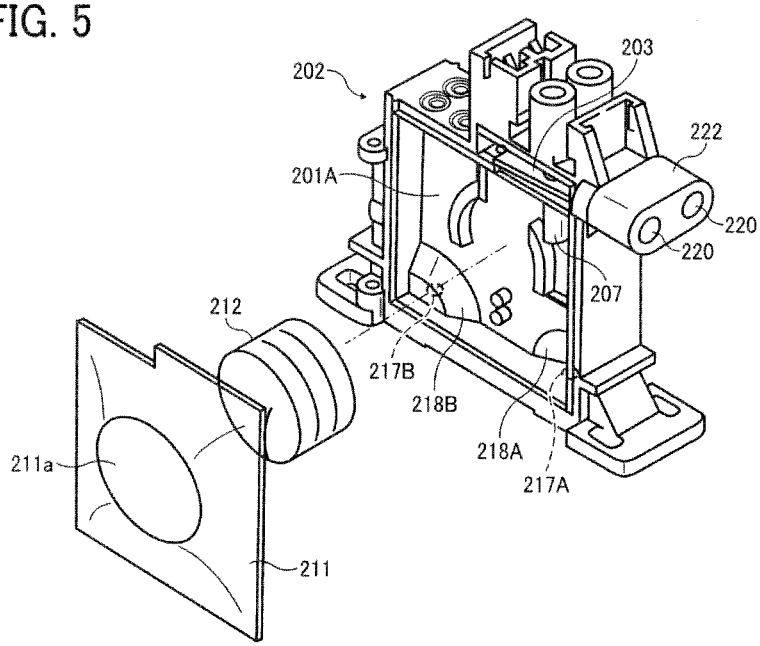
FIG. 5 is an exploded perspective view of the liquid container illustrated in FIG. 3.

Next, a sub tank serving as a liquid container according to an exemplary embodiment of the present disclosure is described with reference to FIGS. 3 to 5.

Figure 3:
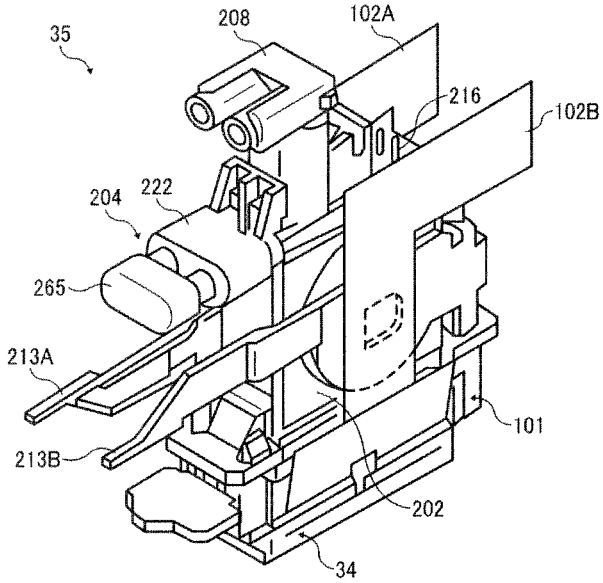
FIG. 3 is a perspective view of a liquid container according to an exemplary embodiment of this disclosure.

FIG. 3 is a perspective view of a head assembly. FIG. 4 is a side view of the head assembly. FIG. 5 is an exploded perspective view of a container main unit (tank body) of a sub tank.

The head assembly includes a single recording head 34, a sub tank 35 to separately supply different color inks to two nozzles rows of the recording head 34, and a filter unit 101 disposed between the sub tanks 35 and the recording heads 34. A first flexible cable 102A and a second flexible cable 102B (collectively referred to as "flexible cables 102" unless distinguished) are connected to the recording head 34 to transmit signals for driving an actuator unit of the recording head 34.

The sub tank 35 has two ink storage portions 201 at lateral sides of a container main unit (tank body) 202 to store ink. A film (flexible film member) 211 is attached by adhesion or welding to an opening of each of the ink storage portions 201 for sealing. Within each of the ink storage portions 201, a spring 212 serving as an elastic member to urge the flexible film member 211 outward is disposed between the container main unit 202 and the flexible film member 211. The flexible film member (film) 211 and the elastic member (spring) 212 form a negative-pressure generator. A negative-pressure detection lever 213 is pivotably mounted to the container main unit 202 to shift an orientation thereof in response to a positional shift of the flexible film member 211.

The sub tank 35 has an air release passage 203 above the container main unit 202 to release air from the ink storage portion 201 to the outside and an air release mechanism 204 to open and close the air release passage 203.

The container main unit 202 has an ink supply port 207 to supply ink to the ink storage portion 201, and a connection member 208 connects a tube 36 to the sub tank 35. The sub tank 35 has two detection electrodes 216 at an upper portion of the container main unit 202 to detect ink.

At a bottom face of the container main unit 202, a first supply port 217A and a second supply port 217B are formed at end portions of the ink storage portions 201A and 201B to separately supply ink from the ink storage portions 201A and 201B to the filter unit 101. Each of the ink storage portions 201 has a protruding portion protruding toward the opposite-side ink storage portion 201 to locate each of the supply ports 217 at a middle portion between the ink storage portions 201A and 201B.

Next, the air release mechanism 204 of the sub tank 35 is described with reference to FIG. 6.

Figure 6:
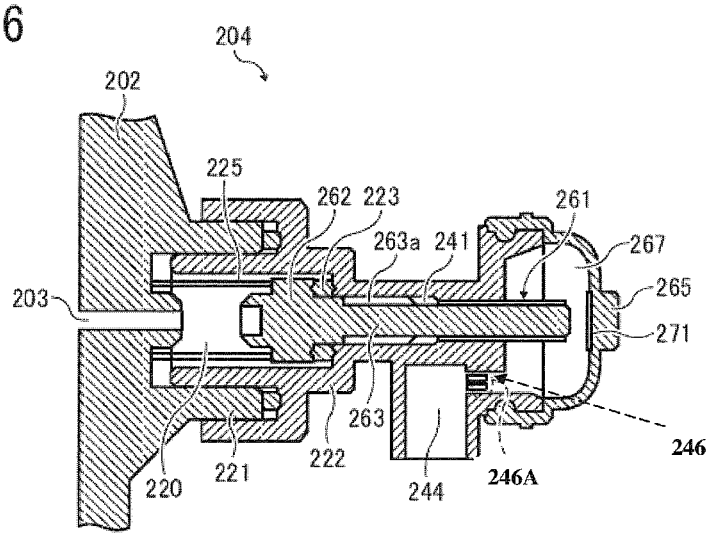
FIG. 6 is a cross-sectional view of an air release mechanism of the liquid container illustrated in FIG. 3.

FIG. 6 is a cross-sectional view of the air release mechanism 204. At an upper lateral side of the container main unit 202, the air release mechanism 204 has a hollow holder-mount portion 221 that is connected to the air release passage 203 and includes an air release channel 220 to communicate the inside of the container main unit 202 with the outside of the container main unit 202. A holder 222 serving as a hollow cylindrical member is mounted to the holder-mount portion 221.

A valve unit 261 is slidably mounted within the holder 222. The valve unit 261 has a valve body 262 and a movable member 263. The movable member 263 is integrally formed with the vale body 262 and disposed at a side (air side) more proximal to outside air than the vale body 262 (that is, at a side more distal to the air release passage 203 than the vale body 262) within the holder 222. Together with a valve seat 223 that is a gasket member fitted in the holder 222, the valve body 262 of the valve unit 261 forms a valve assembly. The valve unit 261 and the valve body 262 are pressed (urged) against the valve seat 223 by a spring 225 to shut down the air release channel 220 (communicating with the inside of the container main unit 202) from outside air. By contrast, the movable member 263 is pressed by, e.g., a pressing member from the outside of the air release mechanism 204 to release the air release channel 220 (communicating with the inside of the container main unit 202) to outside air.

A deformable sealing member, in this embodiment an elastic-body cover member (cap member) 265, is mounted on the holder 222. A rigid member 271 is mounted on a portion of the elastic-body cover member 265 that contacts the movable member 263.

Figure 7:
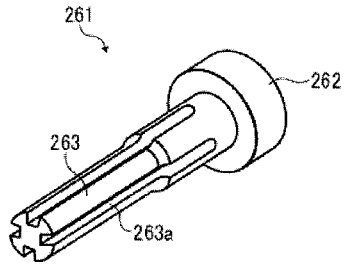
FIG. 7 is a perspective view of a valve unit of the air release mechanism illustrated in FIG. 6.

As illustrated in FIG. 7, the movable member 263 of the valve unit 261 has multiple longitudinal grooves 263a cut into the outer circumferential surface of the movable member 263 that extend substantially the entire length of the movable member 263 and are spaced substantially equidistantly thereabout. The movable member 263 is held in the holder 222 in such a manner that an outer circumferential surface of the movable member 263 is slidable over an inner circumferential surface of the holder 222 to form a first air communication channel 241 serving as a first communication channel constituting part of the air release channel 220 between the grooves 263*a* and the inner circumferential surface of the holder 222. In addition, a second air communication channel 246 serving as a second communication channel is formed within the holder 222. The second air communication channel 246 has a filter structure 246A therein to remove foreign substances and is connected to a space 267 between the holder 222 and the elastic-body cover member 265 and a vent portion 244 that is opened to outside air and directed downward in a height direction of the sub tank 35. Thus, the first air communication channel 241 communicates with outside air via the space 267, the second air communication channel 246, and the vent portion 244.

Here, the filter structure 246A of the second air communication channel 246 is described with reference to FIGS. 8 to 10.

Figure 8:
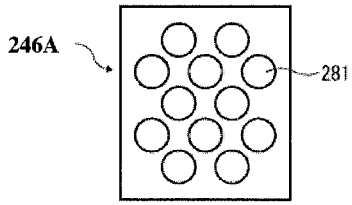
FIG. 8 is a schematic view of an example of a filter structure of a second communication channel.
Figure 9:
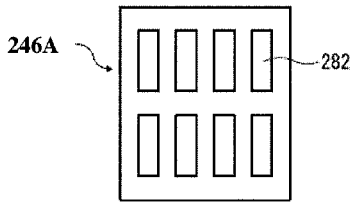
FIG. 9 is a schematic view of another example of the filter structure of the second communication channel.

FIG. 8 shows a case in which circular holes 281 are formed in the filter structure 246A of the second air communication channel 246. The opening diameter of the holes 281 is preferably the same as the diameter of the nozzles or smaller. FIG. 9 shows a case in which rectangular holes 282 are formed in the filter structure 246A. FIG. 10 shows a case in which recessed portions 283 of, e.g., conical trapezoid or polygonal pyramid are formed from both sides so that opposed ones of the recessed portions 283 partially communicate with each other at the bottom faces.

Figure 10:
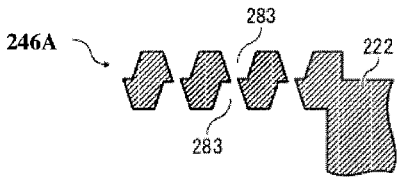
FIG. 10 is a schematic view of still another example of the filter structure of the second communication channel.

Forming such tapered recessed portions as illustrated in FIG. 10 facilitates punching or molding.

As described above, the second communication channel of the cylindrical member has the filter structure to remove foreign substances. In other words, the cylindrical member has a filter portion. As compared with a case in which a filter member is mounted to the cylindrical member as another member independent of the cylindrical member, the above-described configuration can reduce entry of foreign substances and prevent or reduce operation failure of the valve unit, thus allowing stable liquid supply.

As described above, the rigid member 271 of, e.g., a plate shape is mounted to the contact portion of the cover member 265 that contacts the movable member 263. The rigid member 271 may be mounted to both faces of the cover member 265. Alternatively, if the sealing performance is reliably obtained by, e.g., two-color molding or insertion molding, the rigid member 271 may be disposed within the cover member 265.

The rigid member 271 is made of, e.g., metal piece, metal sheet, resin piece, resin sheet, and/or any other material capable of maintaining the shape thereof against load from the spring 225 or the valve unit 261. However, in a case in which the rigid member 271 is formed by two-color molding (e.g., the cover member 265 is made of elastomer such as thermoplastic elastomer), the rigid member 271 is preferably made of, e.g., acrylonitrile butadiene styrene (ABS), polycarbonate (PC), or polypropylene (PP). Alternatively, in a case in which the rigid member 271 is formed by insertion molding (e.g., the cover member 265 is made of rubber or elastomer), the rigid member 271 is preferably made of heat resistant metal. In a case in which the cover member 265 is a flexible film, the rigid member 271 may be adhered to the cover member 265 with, e.g., double-faced adhesive tape. In such a case, to prevent separation of the rigid member 271, sheets enhanced by thickening printing or sheets having only portions contacting the movable member 263 are preferably laminated on the rigid member 271.

When the interior of the main container unit 202 is released to outside air, both the pressing force of the spring 225 and the pressing force for pressing the movable member 263 from the outside are applied to the cover member 265. Hence, as described above, the rigid member 271 is disposed to enhance the strength of the cover member 265.

In other words, when the air release mechanism 204 is activated to release the interior of the main container unit 202 to outside air, a pressing member presses the cover member 265 from the outside to the inside to contact the cover member 265 with the movable member 263 of the valve unit 261. As a result, the valve unit 261 including the movable member 263 is pushed to separate the valve body 262 from the valve seats 223. Thus, the interior of the main container unit 202 is released to outside air via the air release channel 220, the first air communication channel 241, the space 267, the second air communication channel 246, and the vent portion 244.

At this time, because the cover member 265 is deformable and the portion of the cover member 265 that contacts the movable member 263 deforms, the operation amount (movement amount) of the valve unit 261 may decrease. The decrease amount in the movement amount of the valve unit 261 varies depending on the rigidity or thickness of the cover member 265. As a result, because the movement amount of the valve unit 261 may vary, the pushed amount of the cover member 265 need be increased, thus increasing load to the cover member 265.

Hence, as described above, the rigid member 271 is disposed at the portion of the cover member 265 that contacts the movable member 263 of the valve unit 261 to increase the rigidity. Such a configuration can reduce the pushed amount of the cover member 265 and the load to the cover member 265, thus stabilizing the operation amount of the valve unit 261.

In the above-described exemplary embodiment, the image forming apparatus is described as a serial-type image forming apparatus. However, the image forming apparatus is not limited to a serial-type image forming apparatus and may be, e.g., a line-head-type image forming apparatus.

Numerous additional modifications and variations are possible in light of the above teachings. It is therefore to be understood that, within the scope of the appended claims, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A liquid container comprising:

a container main unit to store liquid to be supplied to a recording head for ejecting droplets of the liquid;

an air release passage that communicates with an interior of the container main unit to release the interior of the container main unit to outside air; and an air release mechanism connected to the air release passage to open and close the air release passage, the air release mechanism including:

a hollow cylindrical member connected to the air release passage;

a valve seat disposed within the cylindrical member;

a valve body movably disposed within the cylindrical member to come into contact with and separate from the valve seat;

a movable member movably disposed at a side more proximal to outside air than the valve body within the cylindrical member to move the valve body, the movable member having an outer circumferential surface slidable over an inner circumferential surface of the cylindrical member and forming a first communication channel to communicate with outside air;

an elastic cover member mounted to the cylindrical member to cover the movable member; and a second communication channel formed within the cylindrical member and connected to a space between the cylindrical member and the cover member to communicate the first communication channel with outside air via the space and the second communication channel, wherein the cylindrical member includes a filter portion having a filter structure to remove foreign substances, the filter portion of said cylindrical member being disposed within the second communication channel.

2. The liquid container according to claim 1, further comprising a rigid member disposed at a portion of the cover member that contacts the movable member.

3. The liquid container according to claim 1, wherein the air release mechanism further comprises a vent portion directed downward in a height direction of the liquid container and connected to the second communication channel to communicate the second communication channel with outside air.

4. The liquid container according to claim 1, wherein the movable member has a longitudinal groove in the outer circumferential surface of the movable member to form the first communication channel.

5. The liquid container according to claim 1, wherein the movable member is integrally formed with the valve body.

6. The liquid container according to claim 1, wherein the filter portion is an integral portion of said cylindrical member.

7. The liquid container according to claim 1, wherein the filter structure of the filter portion includes plural holes in a filter member of the cylindrical member.

8. An image forming apparatus including a liquid container, the liquid container comprising:

a container main unit to store liquid to be supplied to a recording head for ejecting droplets of the liquid;

an air release passage that communicates with an interior of the container main unit to release the interior of the container main unit to outside air; and an air release mechanism connected to the air release passage to open and close the air release passage, the air release mechanism including:

a hollow cylindrical member connected to the air release passage;

a valve seat disposed within the cylindrical member;

a valve body movably disposed within the cylindrical member to come into contact with and separate from the valve seat;

a movable member movably disposed at a side more proximal to outside air than the valve body within the cylindrical member to move the valve body, the movable member having an outer circumferential surface slidable over an inner circumferential surface of the cylindrical member and forming a first communication channel to communicate with outside air;

an elastic cover member mounted to the cylindrical member to cover the movable member; and a second communication channel formed within the cylindrical member and connected to a space between the cylindrical member and the cover member to communicate the first communication channel with outside air via the space and the second communication channel, wherein the cylindrical member includes a filter portion having a filter structure to remove foreign substances, the filter portion of said cylindrical member being disposed within the second communication channel.

9. The image forming apparatus according to claim 8, wherein the liquid container further comprises a rigid member disposed at a portion of the cover member that contacts the movable member.

10. The image forming apparatus according to claim 8, wherein the air release mechanism further comprises a vent portion directed downward in a height direction of the liquid container and connected to the second communication channel to communicate the second communication channel with outside air.

11. The image forming apparatus according to claim 8, wherein the movable member has a longitudinal groove in the outer circumferential surface of the movable member to form the first communication channel.

12. The image forming apparatus according to claim 8, wherein the movable member is integrally formed with the valve body.

13. The image forming apparatus according to claim 8, wherein the filter portion is an integral portion of said cylindrical member.

14. The image forming apparatus according to claim 8, wherein the filter structure of the filter portion includes plural holes in a filter member of the cylindrical member.

* * * * *